US005468369A

United States Patent [19]

Muldowney

[11] Patent Number: 5,468,369

[45] Date of Patent: Nov. 21, 1995

[54] FCC PROCESS WITH UPFLOW AND DOWNFLOW REACTOR

[75] Inventor: Gregory P. Muldowney, Glen Mills, Pa.

[73] Assignee: Mobil Oil Corporation, Fairfax, Va.

[21] Appl. No.: 176,978

[22] Filed: Dec. 27, 1993

[51] Int. Cl.[6] ..... C10G 11/00; C10G 11/05

[52] U.S. Cl. ..... 208/113; 208/117

[58] Field of Search ..... 208/113; 422/139, 422/140, 144, 147

[56] References Cited

U.S. PATENT DOCUMENTS

| | | | |
|---|---|---|---|
| 2,358,497 | 9/1944 | Egloff | 422/144 |
| 4,385,985 | 5/1983 | Gross et al. | 208/113 |
| 4,808,383 | 2/1989 | Buyan et al. | 422/140 |
| 5,045,176 | 9/1991 | Walters et al. | 208/113 |
| 5,308,474 | 5/1994 | Cetinkaya | 208/113 |
| 5,318,691 | 6/1994 | Muldowney | 208/113 |

OTHER PUBLICATIONS

"Development of Catalytic Cracking Technology, A Lesson in Chemical Reactor Design", A. A. Avidan and R. Shinnar, I&EC Research, 1990, 29.

*Primary Examiner*—Asok Pal
*Assistant Examiner*—Patrick J. Neill
*Attorney, Agent, or Firm*—Alexander J. McKillop; Malcolm D. Keen; Richard D. Stone

[57] ABSTRACT

A process and apparatus for short contact time fluidized catalytic cracking of heavy oil feed using a reactor with an upflow cat:oil vaporizer and a downflow reactor. Catalyst slip permits efficient mixing and limited conversion in the upflow section, while cracking is completed in the downflow reactor with minimal segregation of catalyst. FCC catalyst with more than 25 wt % Y zeolite content is preferred, and total vapor residence time should be less than 5 seconds.

17 Claims, 2 Drawing Sheets

FCC PROCESS WITH UPFLOW AND DOWNFLOW REACTOR

BACKGROUND OF THE INVENTION

This invention relates to fluid catalytic cracking.

BACKGROUND OF THE INVENTION

Many refineries devote extraordinary amounts of energy and operating expense to convert most of a whole crude oil feed into high-octane gasoline. The crude is fractionated to produce a virgin naphtha fraction which is usually reformed, and a gas oil and/or vacuum gas oil fraction which is catalytically cracked to naphtha and light olefins. The naphtha is added to the gasoline blending pool, while the light olefins are converted (usually by HF or sulfuric acid alkylation) into gasoline boiling range material which is also added to the gasoline pool.

Catalytic cracking began as a fixed bed process for conversion of gas oil to high-octane gasoline and light olefins. The process evolved to a moving bed configuration, and finally became a fluid bed process. Each improvement displaced earlier process configurations amid considerable competition. The fluid bed process itself, known as FCC, underwent much evolution. FCC began with "folded riser" reactors—trombone-like tubular conduits with ascending-descending flow—having 10 to 60 seconds residence time and limited conversion to gasoline. Such a unit is shown in FIG. 11 of the O&GJ Fluid Catalytic Cracking Report, OGJ, Jan. 8, 1990. Such folded reactor risers were essential at the time because the catalysts used had such low activity that a straight riser would be impractically tall. Even today some pilot plants are reported to use folded riser reactors, again primarily to overcome height constraints.

Some folded riser reactors were converted to larger diameter reactors to increase solids holdup without use of folded risers. Other units resorted to dense-bed cracking in which oil contacted fluidized catalyst in a vessel reactor, achieving longer residence time and higher conversion.

Most recently FCC has evolved to all riser cracking, with straight vertical riser reactors having 1 to 10 seconds residence time and conversion as high as 85 volume percent.

The fate of fixed-bed and moving-bed cracking was sealed with the advent of zeolite-based cracking catalyst, which revolutionized petroleum refining in the 1960s. High-activity zeolite catalyst, having several orders of magnitude more cracking activity than amorphous catalysts, made short residence time, all-riser cracking the preferred design for new units. Today no fixed bed cracking units operate. No new moving bed units are being built, and refiners have converted essentially all earlier FCC units into riser units. The only new reactor design under active construction is a downflow vertical tubular reactor, which can operate with contact times less than 1 second.

The FCC process is now the preferred process in the petroleum refining industry for converting higher boiling petroleum fractions into lower boiling products, most notably gasoline and light olefins. A finely divided solid catalyst promotes the cracking reactions. The catalyst typically consists of particles 20–100 microns in diameter with an average diameter of 60–75 microns. When combined with gas, the catalyst acts like a fluid (hence the designation FCC) and circulates in a closed loop between a cracking zone where oil is converted and a regeneration zone where coke laid down during cracking is burned off to prepare the catalyst for reuse.

A further description of the FCC process may be found in the monograph, "Fluid Catalytic Cracking with Zeolite Catalysts" Venuto and Habib, Marcel Dekker, N.Y., 1978, incorporated by reference.

One of the most important but least understood parts of the FCC process is the mixing of catalyst and oil feed in a short residence time reactor. The two reactor types for short reaction times are risers and downers. In a riser, feed and catalyst meet at the base of vertical tubular conduit and travel upward in dilute-phase flow against the force of gravity, the cracked products being discharged at the top. In a downer (or dropper), feed meets catalyst at the top of a vertical tube and the mixture flows downward under both gravity and the momentum of the entering flows. Products are separated from the catalyst at the bottom of the reactor and discharged. Each reactor configuration has benefits and each has at least one major drawback. The two reactor types are reviewed briefly.

Upflow (Riser) Reactors

Almost all FCC units today use riser reactors and operate at 5 to 20 seconds catalyst residence time. A few older units have a riser which discharges into a fluidized dense-bed reaction zone where a limited amount of additional conversion occurs.

The distinguishing feature of all riser reactors is catalyst-oil slip, that is a difference in upward velocity between the vapor and solid phases in the reactor. Both catalyst and oil travel vertically upward, but the oil moves faster, flowing through the spaces between the slower catalyst particles. Typically the oil velocity is 2 to 3 times that of the catalyst, and the oil residence time proportionately shorter. Thus as the catalyst takes 5 to 20 seconds to pass up the full length of the riser, the oil may take only 3 to 8 seconds. The ratio of catalyst and oil residence times is called the slip factor. It is important to note that slip occurs only because gravity acts to a greater extent on the solids than on the vapor, retarding the catalyst flow to a larger degree. If the flow were not opposed to gravity, this effect would be minimal.

In commercial risers having diameters of several feet, slip is only one of various flow irregularities which occur. Solids in a riser flow upward as a result of drag by the surrounding gas, but the gas velocity is smaller near the riser walls than at the centerline. Consequently the solids near the walls travel upward very slowly relative to those near the center, and in some cases flow downward instead. Gamma-ray scans have been made of FCC risers to clarify the flow behavior inside, and often a region of extremely high density is detected at the walls which is dubbed the "river of catalyst" flowing downward, that is, refluxing. Because the wall region is dense with slow-moving solids, the path of least resistance for the vapor flow becomes the core. The oil vapor therefore migrates to the center as it rises, further slowing the lift velocity at the wall and amplifying the radial partitioning of the catalyst and oil. The resulting profile is often called a "core-annular" flow because it consists of a core of gas and an annulus of solids. Such flow behavior is extremely detrimental to FCC product selectivities because much of the oil ends up being converted in a catalyst-lean region where the contribution of purely thermal cracking is larger. Moreover, any catalyst which manages to remain in the core flow is exposed to a disproportionate amount of oil and deactivates faster than expected, exhausting its cracking capacity long before reaching the top of the riser. This invites thermal cracking to take over late in the riser traverse. The result in either case is loss of gasoline and light olefins to light gases and coke, a severe degradation of the FCC yield structure.

While risers suffer from significant flow nonidealities somewhat higher up, the base of a riser can work quite efficiently because the flow is opposed to gravity. Catalyst/oil mixing is enhanced when the oil is injected into a region of high solids density because this affords rapid heat transfer and a short diffusion path for the reacting species.

A preferred catalyst/oil mixer based on these criteria is described in my co-pending application, FCC RISER CRACKING WITH VORTEX CATALYST/OIL MIXING, U.S. Ser. No. 08/061,404, filed May 25, 1993 and now U.S. Pat. No. 5,318,691, granted Jun. 7, 1994, which is incorporated by reference. Oil is injected into vortices of catalyst induced by strategic shaping of the flow channel.

Gravity, by retarding solids upflow, acts to preserve catalyst-rich volumes in the mixing zone and increase the likelihood of immediate small-scale mixing. Even the refluxing of solids at the riser walls, although it negatively impacts cracking kinetics, can give better performance in the mixing region itself.

To achieve the most effective mixing possible in a riser, much effort has been spent developing better FCC feed nozzles and other enhancements to the mixing region to rapidly contact 1 to 10 tons per minute of oil with 4 to 8 times this amount of catalyst at the riser base.

U.S. Pat. No. 5,108,583 is one of many FCC feed nozzle patents, and is incorporated by reference. U.S. Pat. Nos. 4,717,467 and 4,578,183, incorporated by reference, are directed to modifying the riser base to make better use of feed nozzles. A venturi section, or draft tube, is used to promote better contact of feed and hot catalyst. These approaches—better nozzles, different riser configurations—help optimize the mixing section but cannot eliminate the flow irregularities which occur further up in riser reactors nor the resulting yield penalties.

Downflow (Downer Or Dropper) Reactors

While riser reactors are used in essentially all new FCC construction, some refiners have tried downflow reactors at least at the semi-commercial scale. Most downflow units were built in pursuit of extremely short contact times out of the conviction that certain yield limits of conventional cracking conditions could be overcome. While current state-of-the-art risers have oil residence times as low as 1.5 seconds, many downflow units achieve contact times far less than 1 second, approaching 0.1 seconds. As with risers, much of the development work for downflow necessarily focused on achieving good initial catalyst/oil mixing. The distinguishing feature of downflow is that, because there is little or no slip, the relative position of the catalyst and oil remain largely fixed as the mixture passes down the length of the reactor. That is, the vapor and the solids are both falling due to both initial momentum and gravity. There is no retarding force which brings about a disparity in velocity between the two phases. If a tiny observer were standing on a catalyst particle in a riser, he would see oil passing upward around him. In a downer, he would see oil vapor approximately stagnant around him.

Because there is no slip, catalyst and oil do not radially segregate in a downflow reactor. No core-annular or similar flow forms; the velocity profile varies with radius in the same manner for the solids and the vapor. In other words, the phases retain throughout the entire reactor exactly the state of admixture which they have upon leaving the mixing section at the top. The solids do not migrate, stall, scatter, or clump. For this reason downflow reactors cannot induce suboptimal kinetics due to radial phase separation.

The shortcoming of a downflow reactor is that initial catalyst/oil mixing can be difficult to achieve because gravity acts to decrease the solids density in the zone of initial contacting, contrary to the effects noted in a riser. Entering solids tend to drop immediately downward and cannot reflux or circulate in any way which might enhance initial heat and mass transfer with the oil. If the inlet flows of catalyst and oil were perfectly steady and perfectly balanced, this effect would be less important. However fluidized solids flow is never truly steady and usually features small-amplitude oscillations in solids density whether moving in a riser or a downer. Thus the gas-solids mixture in a cracking reactor actually consists of alternating catalyst-rich and catalyst-lean pulses, the variations being fairly small. In a riser the pulses have little impact because oil vapor, traveling faster than catalyst, passes through the regions of high and low solids density and experiences on balance the proper (average) cat-to-oil ratio. A downer, by contrast, has no mechanism for moving oil from catalyst-lean to catalyst-rich regions and vice versa. Oil which enters in a region of low solids density will remain there through the entire reactor, ultimately subject to thermal cracking due to premature deactivation of the catalyst as noted earlier. Oil in a high-density region may be overcracked. Hence the products of low cat-to-oil and high cat-to-oil do not in any way "average" to the products of the correct cat-to-oil.

Various configurations of downflow cracking are taught in the prior art. U.S. Pat. No. 4,832,825 uses a riser of 5 to 40 meters and high velocity in the reactor to achieve hydrocarbon residence times of 0.05 to 10 seconds. Material exiting the riser [1] is deflected down by a cap to effect some measure of separation between cracked product and spent catalyst.

U.S. Pat. No. 4,919,898, Gartside et al, incorporated by reference, teaches a short contact time apparatus for cracking hydrocarbon with hot solids. An annular falling curtain of hot solids contacts opposing spray feed nozzles. Catalyst flow is controlled by changing the pressure (via steam injection) in a solids reservoir above a plug valve [14] having a spherical base portion with arcuate contours [15]. There is fairly efficient formation of a large surface area annular sheet of catalyst, but the nozzle configuration does not ensure uniform catalyst/oil contact circumferentially around the contours [15]. The nozzles are essentially point sources while the catalyst forms a plane; perfect contact of a plane with a plurality of points is not possible. The catalyst and oil mixture passes down into a larger separation area comprising a horizontal plate above which cracked gases are withdrawn. The gases thus follow a 180-degree path from inlet to outlet, a configuration claimed to achieve 95 to 99% solids separation efficiency.

U.S. Pat. No. 4,433,984, incorporated by reference, teaches a short contact time cracking process with rapid separation of solids from cracked gases leaving a cracking reactor.

U.S. Pat. No. 4,985,136, incorporated by reference, shows a falling curtain FCC reactor, using very high zeolite content cracking catalyst (40 to 80% zeolite) to crack heavy feed within 0.5 seconds or less. Catalyst falls vertically downward and oil is injected horizontally into the plane of solids, both phases passing to a cyclone separator [66]. The cyclone dipleg discharges catalyst into a large stripping section [10].

Upflow Vs. Downflow

While many improvements have been made to develop an effective short contact time cracking process, none are entirely satisfactory. A simple summary of upflow versus downflow is: phase segregation in risers is radial and in downers is axial. Consequently risers are better mixers and downers are better crackers.

I realized that most of the difficulties of the existing approaches to short contact time cracking with high-activity catalyst could be overcome by designing a reactor to exploit two facts:

(1) Catalyst/oil mixing is more effective in upflow.

(2) Catalyst/oil reactions have advantages in downflow.

I devised a reactor which made optimum use of the desirable features of each type of reactor. In risers the phenomenon of catalyst/oil slip is a virtue at the base (for mixing) but a vice further up (for cracking). In downers the lack of slip is suboptimal at the inlet (for mixing) but advantageous further down (for cracking). My reactor design permits short contact time cracking of heavy feeds with high activity zeolite catalysts, and achieves both vigorous catalyst/oil mixing and predominantly catalytic cracking without the influence of overspent catalyst anywhere in the reactor.

BRIEF SUMMARY OF THE INVENTION

Accordingly, the present invention provides a process for the fluidized catalytic cracking of a hydrocarbon feed oil containing liquid hydrocarbons boiling above 650° F. to catalytically cracked products comprising upflow vaporization of liquid feed by contacting liquid feed with a source of regenerated catalyst containing at least 10 wt % zeolite, based on the zoolite content of fresh or makeup catalyst to the FCC unit, in a base portion of a vertical vaporizer comprising a vertical tube at feed vaporization conditions including a hydrocarbon residence time of 0.05 to 5.0 seconds, and wherein said vaporization conditions are sufficient to vaporize the feed and convert less than 50%, by weight, of the feed to products boiling below 650° F., to produce a vaporized mixture of feed which is completely vaporized but only partially converted and catalyst which is discharged up from said vertical vaporizer; reversing the direction of flow of said partially converted feed and catalyst; and downflow cracking of said vaporized mixture in a vertical reactor having a height of 5 to 150 feet, a top portion receiving said partially converted feed and catalyst and a bottom portion discharging cracked products and spent catalyst, said reactor operating at downflow cracking conditions including a hydrocarbon residence time of 0.05 to 5.0 seconds, and sufficient to convert additional amounts of feed to cracked products boiling below 650 F. to produce a downflow cracking reactor product mixture of spent cracking catalyst and cracked hydrocarbons which are discharged from the bottom of said downflow reactor and wherein at least 50 wt % of said vaporized hydrocarbons are cracked products boiling below 650° F.; separating said downflow reactor product mixture in a solids/vapor separation means to produce a vapor phase of cracked products which is recovered as a product and a solids rich stream of spent cracking catalyst containing coke and strippable hydrocarbons; stripping said spent catalyst in a stripping means operating at catalyst stripping conditions to produce stripped catalyst containing coke; regenerating said stripped catalyst in a catalyst regeneration means at catalyst regeneration conditions including contact with an oxygen containing gas to produce regenerated catalyst; and recycling said regenerated catalyst to said base portion of said vertical vaporizer.

In another embodiment, the present invention provides a process for the fluidized catalytic cracking of a hydrocarbon feed oil containing liquid hydrocarbons boiling above 650° F to catalytically cracked products comprising: upflow vaporization of liquid feed by contacting liquid feed with a regenerated catalyst containing at least 25 wt % zeolite, based on the zeolite content of-makeup catalyst to the FCC unit, in a base portion of a vertical vaporizer comprising a vertical tube at feed vaporization conditions including a hydrocarbon residence time of 0.05 to 5.0 seconds, and wherein said vaporization conditions include a catalyst residence time at least twice that of hydrocarbon feed and sufficient to vaporize all the feed but convert less than 50% by weight to products boiling below 650° F. and produce a mixture of vapor and catalyst discharged up from said vaporizer; smoothly reversing the direction of flow of said vapor and catalyst without inertially separating catalyst from vapor to produce a downflowing mixture; downflow cracking of said downflowing vaporized mixture in a vertical reactor having a height of 5 to 150 feet, a top portion receiving said downflowing mixture and a bottom portion discharging cracked products and spent catalyst, said reactor operating at downflow cracking conditions including a hydrocarbon residence time of 0.05 to 5.0 seconds, a catalyst residence time no greater than the residence time of said hydrocarbon and sufficient to convert additional amounts of feed to cracked products boiling below 650° F. to produce a product mixture of spent cracking catalyst and cracked hydrocarbons which are discharged from the bottom of said downflow reactor and wherein at least 50 wt % of said vaporized hydrocarbons are cracked products boiling below 650° F.; inertially separating cracked products from spent catalyst discharged from said bottom of said downflow reactor in a solids/vapor separation means to produce a vapor phase of cracked products which is recovered as a product and a solids rich stream of spent cracking catalyst containing coke and strippable hydrocarbons; stripping said spent catalyst in a stripping means operating at catalyst stripping conditions to produce stripped catalyst containing coke; regenerating said stripped catalyst in a catalyst regeneration means at catalyst regeneration conditions including contact with an oxygen containing gas to produce regenerated catalyst; and recycling said regenerated catalyst to said base portion of said vertical vaporizer.

In an apparatus embodiment, the present invention provides an apparatus for vaporizing and catalytically cracking a hydrocarbon feed comprising a vertical vaporizer of a vertically disposed elongated tubular conduit having a lower portion and an upper portion, said lower portion having inlets for feed and cracking catalyst and said upper portion having an outlet for a mixture of vaporized feed and catalyst; a flow reverser connective with the outlet of said vertical vaporizer for diverting a discharged mixture down into a downflow reactor; a vertical downflow reactor having an upper portion and a lower portion, said upper portion connected with said flow reverser and receiving a mixture of vapor and catalyst discharged from said vertical vaporizer; and a catalyst and vapor separation means connected to said lower portion of said vertical downflow reactor.

DETAILED DESCRIPTION OF PREFERRED EMBODIMENTS

Figure 1:
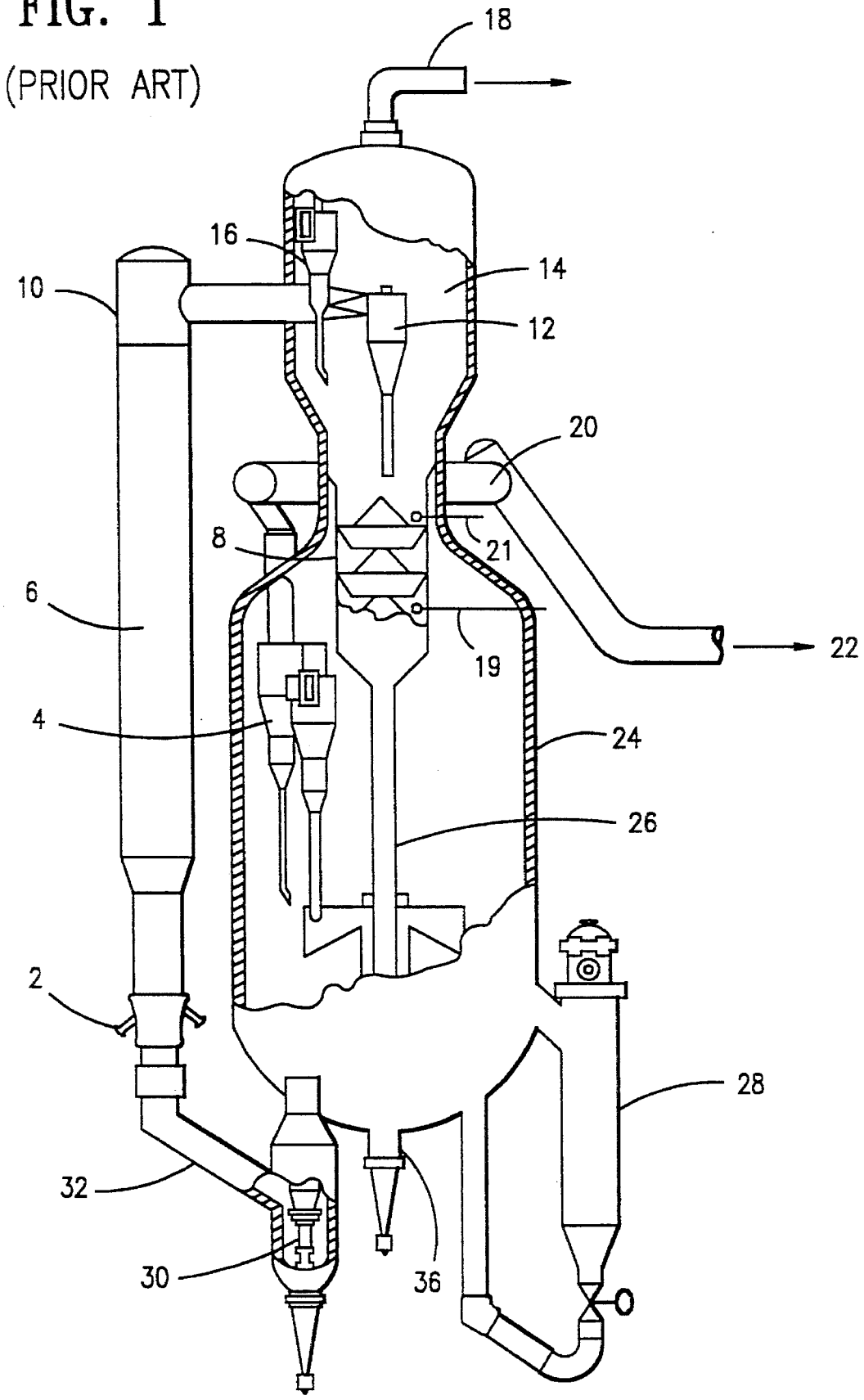
FIG. 1 (PRIOR ART)
FIG. 1 (Prior Art) shows a conventional FCC unit with a riser reactor.

FIG. 1 (Prior Art) is a simplified schematic view of an FCC unit of the prior art, similar to the Kellogg Ultra Orthoflow converter Model F shown as FIG. 17 of Fluid Catalytic Cracking Report, in the Jan. 8, 1990 edition of Oil & Gas Journal.

A heavy feed such as a gas oil or vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually is removed via upper cyclones 16 and conduit 18 to the fractionator.

Spent catalyst is discharged down from the diplegs of riser cyclones 12 into catalyst stripper 8, where one, or preferably or more, stages of steam stripping occur, with stripping steam admitted via lines 19 and 21. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28 is provided so heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed. Flue gas, and some entrained catalyst, are discharged into a dilute phase region in the upper portion of regenerator 24. Entrained catalyst is separated from flue gas in multiple stages of cyclones 4, and the gas is discharged into plenum 20 for discharge to the flare via line 22.

Figure 2:
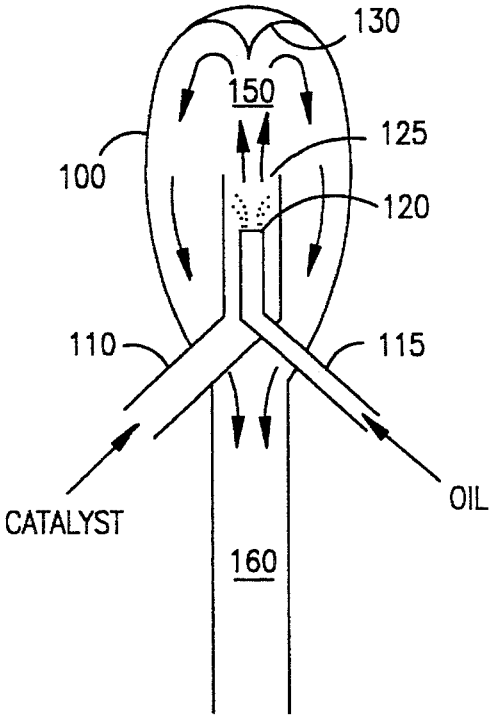
FIG. 2 (Invention) shows an FCC reactor with an upflow internal mixing section connected by a smooth conduit to a downflow cracking section.

FIG. 2 (invention) is a simplified cross-sectional view of an internal mixer downflow reactor. This embodiment shows a poor and fairly conventional catalyst and oil upflow mixing section followed by a downflow reactor.

A stream of hot regenerated catalyst is charged via line 110 into reactor 100. Oil, preferably mixed with some atomizing steam, is charged via line 115 and discharged via orifice tip outlet 120 to contact catalyst. The upflowing catalyst/oil mixture is discharged via opening 125 into flow reversal region 150 in the top of reactor 100. The gas-solids flow encounters surface 130 which may be a half-torus or similar shape which preferably provides a smooth bend on the inner surface to redirect the upflowing mixture into a smooth downward flow into the downflow reactor section 160. Spent catalyst and cracked products are discharged from the base of the downflow section and can be separated by other hardware not shown, conventional or otherwise, such as cyclones, inertial devices, gravity settlers, and so forth.

The upflow mixing region includes those portions of the reactor 100 in which catalyst and oil flow up or across the reactor, generally indicated as region 150. The downflow reactor section 160 includes those portions where there is cocurrent downward flow of catalyst and oil.

The initial catalyst/oil mixing portion shown, having an orifice tip for oil injection into an upflowing stream of catalyst, is conventional but not preferred. The invention is preferably implemented using dense phase, vortex mixing of catalyst and oil as discussed in conjunction with the review of FIG. 3.

Figure 3:
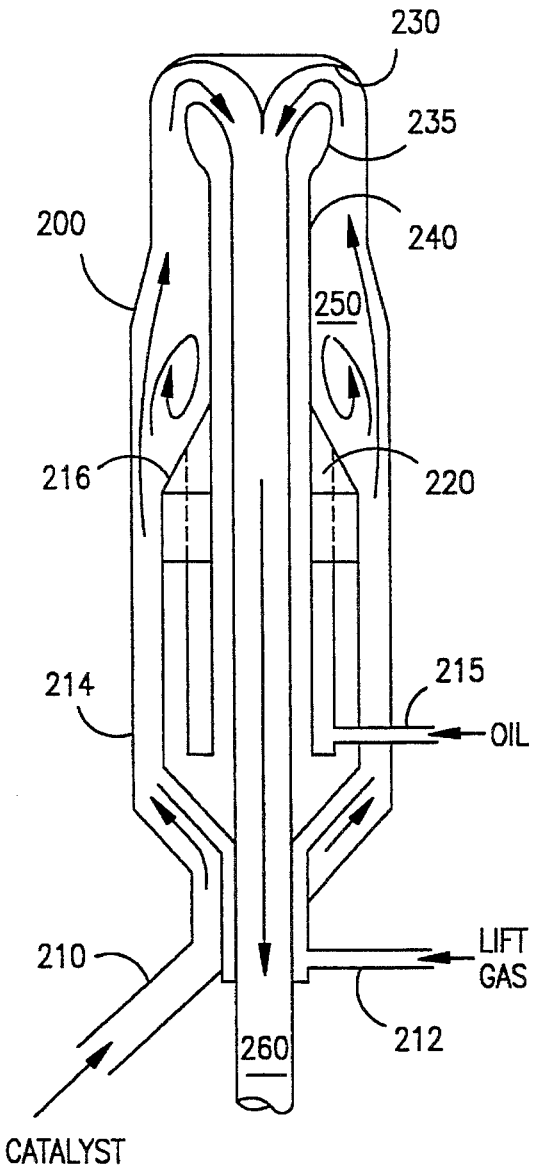
FIG. 3 (Invention) shows an FCC reactor with an upflow external mixing section connected by a smooth conduit to a downflow cracking section.

FIG. 3 (Invention) is a simplified cross-sectional view of an upflow-downflow reactor with an external mixing section. This embodiment shows a preferred initial catalyst/oil contacting device based on vortex mixing. Hot regenerated catalyst is charged via line 210 to reactor 200. Lift gas is optional but may be added via line 212 to aid in lifting catalyst up into the vortex region of the mixing device. Oil, possibly mixed with atomizing steam, is charged via line 215 through a plurality of outlets 220 at a relatively low velocity to contact catalyst. Catalyst velocity drops upon passing from annular region 214 to the region of larger cross-section created by reduction in diameter of the inner wall formed by conical section 216. This increase in area induces the formation of a recirculating torus of catalyst into which oil is discharged through outlets 220 at relatively low velocity. The recirculation of catalyst in the torus forms a mixing cell of high solids density which significantly improves feed vaporization and catalyst/oil mixing. Additional vaporization and mixing occur as catalyst and oil flow up through region 250 around central pipe 240 to the top of the reactor 200.

The upflowing mixture passes through a smooth bend formed by upper surface 230 and lower surface 235. Catalyst and oil then begin smooth downflow into the downflow region 260. Spent catalyst and cracked products are discharged from the base of the downflow section 260 and separated by means not shown.

The upflow mixing region includes those portions of the reactor 200 where catalyst and oil flow upward, circulate as a torus, or converge on the entrance to the downflow section, generally indicated as region 250. The downflow reactor is the entire volume of central pipe 240, indicated as region 260.

Figure 4:
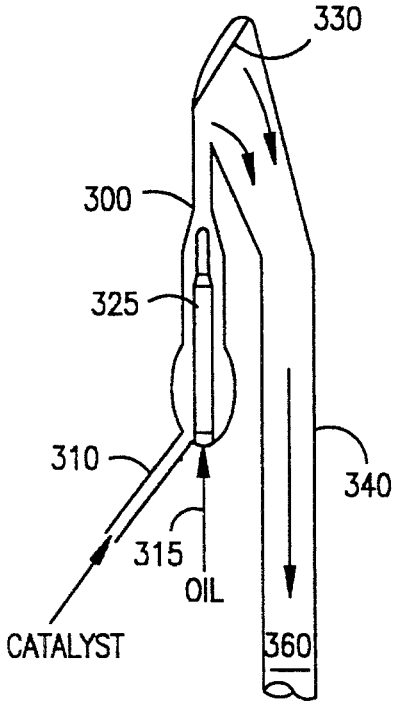
FIG. 4 (Invention) shows an FCC reactor with an upflow mixing section connected to a chamber with a solids impingement surface which is in turn connected to a downflow cracking section.

FIG. 4 (invention) is a simplified cross-sectional view of an upflow-downflow reactor with a vortex mixer and a transition section consisting of an impingement plate.

Hot regenerated catalyst is charged via line 310 to reactor 300. Oil is charged via line 315. Catalyst and oil meet in the preferred type of feed mixing device, a vortex mixer,- generally indicated as 325. Catalyst and oil are discharged upward to contact impingement surface 330, from which they are deflected to one side and downwardly into pipe 340 forming the downflow reaction region 360.

The upflow mixing region consists of the entire flow volume upstream of the impingement surface 330, while the downflow reaction region 360 consists of the entire flow volume downstream of the impingement surface.

Having provided an overview of the process and apparatus of the invention, more details will now be provided about the FCC process and the reactor design.

FCC Feed

Any conventional FCC feed can be used. The process of the present invention is especially useful for processing stocks containing large amounts of non-distillable materials, e.g. 5 wt % or more Conradson Carbon Residue (CCR), and stocks which for any reason are more profitably processed at higher reaction temperatures than conventional FCC.

The feeds may range from the typical, such as virgin or partly refined atmospheric and vacuum distillates of petroleum, to the atypical, such as coal oils, shale oils, and lube extracts. The feed will frequently contain recycled hydrocarbons from catalytic or thermal cracking processes, such as FCC or coker light and heavy gas oils.

The preferred feeds are gas oils, vacuum gas oils, atmospheric resids, and vacuum resids. The invention is most useful with feeds having an initial boiling point above about 650° F.

FCC Catalyst

Typical commercial FCC catalysts may be used. The catalyst must contain relatively large amounts of large-pore zeolite for maximum effectiveness, but such formulations are readily available.

Preferred catalysts for use herein will usually contain at least 10 wt % large-pore zeolite in a porous refractory matrix such as silica-alumina, clay, or the like. The zeolite content is preferably much higher than this, and should usually be at least 20 wt % large-pore zeolite. For optimum results, the catalyst should contain from 30 to 60 wt % large-pore zeolite.

All zeolite contents discussed here refer to the zeolite content of the makeup catalyst rather than that of the equilibrium catalyst (E-cat). Much crystallinity is lost during the average of several months that a catalyst particle spends in the high-temperature steam environment of a modern FCC regenerator, hence the E-cat will contain a much lower zeolite content than the makeup as measured by classical methods. Most refiners characterize makeup catalyst by zeolite content but describe the E-cat in terms of overall cracking activity, using MAT (Modified Activity Test) or FAI (Fluid Activity Index).

The large-pore cracking catalyst may be a conventional zeolite such as X or Y, or an aluminum deficient form such as dealuminized Y (DEAL Y), ultrastable Y (USY) or ultrahydrophobic Y (UHP Y). The zeolites may be stabilized with rare earth metals, for instance 0.1 to 10 wt % rare earth.

Relatively high silica zeolitic catalysts are preferred for use in the present invention because they withstand the high temperatures of the FCC regenerator. Catalysts containing 30 to 60% USY or rare earth USY (REUSY) are especially preferred.

The catalyst inventory may also contain one or more additives, present either as a component of each particle or as an entirely separate particulate solid. Possible additives include CO promoters, SOx capture agents, and octane enhancers (medium-pore or shape-selective zeolites, such as ZSM-5 and others having a Constraint Index of 1–12). The FCC catalyst composition, per se, forms no part of the invention.

FCC Reactor Conditions

Conventional riser cracking conditions may be used, but significant improvements in product selectivities are possible using the process of the present invention at somewhat different reaction conditions.

Typical riser FCC units operate with catalyst/oil weight ratios of 1 to 10, and most are between 4 and 8. Hydrocarbon residence time in the riser is often between 2 and 10 seconds, with newer units tending to shorter contact times such as 2 to 5 seconds. Correspondingly, catalyst residence time in all-riser units is from 5 to 20 seconds in general and 5 to 10 seconds in newer units. Most risers operate with an outlet or "top" temperature of 950° to 1025° F.

Preferably the riser top temperature and cat-to-oil ratio in my process are higher than those used in conventional riser cracking, and the catalyst and hydrocarbon residence times shorter. I prefer to operate with from 5:1 to about 15:1 to 20:1 cat-to-oil, and most preferably the higher ratios. Catalyst residence times should be less than 5 seconds, more preferably 0.1 to 4.0 seconds, and most preferably 0.5 to 1.0 seconds. Hydrocarbon residence times are preferably within 25%, more preferably within 10%, and most preferably within 5%, of catalyst residence times. The reactor outlet temperature is preferably above 1000° F., more preferably between 1025° and 1100° F., and most preferably about 1075° F.

REACTOR INLET SECTION

The upflow section of the reactor is preferably a conduit of the type consistent with all-riser FCC cracking units, such as disclosed in U.S. Pat. No. 4,421,636. It is additionally preferred to have enhancements providing good mixing of feed with catalyst in the base of the reactor: the importance of this feature cannot be overstated. The mixing means may be conventional technology such as multiple injection nozzles, specialized nozzle tips, and/or addition of atomizing steam. More preferably the mixing section has a geometry which induces the formation of regions of high solids density into which the oil is directly released.

Preferably the mixing section is that disclosed in my copending application U.S. Ser. No. 08/061,404, and now U.S. Pat. No. 5,318,691, which forms a circulating torus of catalyst. This torus contains tiny vortices of regenerated catalyst as mixing cells to heat and disperse the feed. This is a preferred, but not essential feature; any conventional feed injection technique involving fair to excellent nozzles, draft tubes, and so forth may also be used.

The function of the inlet/mixing section is to efficiently contact the catalyst and feed and progress the cracking reactions to an extent whereupon the cracking catalyst is not yet sufficiently deactivated to admit substantial thermal cracking. As such the upflow section is at least 5%, but less than 85%, of the total reactor volume and vapor residence time, more preferably from 5 to 50% of the total reactor volume and vapor residence time, and most preferably from 5 to 30% of the total reactor volume and residence time. The preferred fraction of the reactor constituted by the upflow section depends in part on the catalyst and feed used. For heavier feeds or higher activity catalysts the upflow section should be a larger fraction of the total volume and vapor residence time. It should be noted that the volume and residence time ranges noted here refer to the reactor only, exclusive of any separation means, inertial, cyclonic, or otherwise, which may follow the reactor.

The inlet/mixing upflow section may be disposed in various ways relative to the downflow section. FIG. 2 shows an internal mixing section which is surrounded by the downflow section. This configuration requires refractory insulated conduits passing through the downflow section to conduct catalyst and oil to the mixing section. FIG. 3 shows an external mixing section which surrounds the downflow section. This design has the advantage that no conduits cross the downflow section and the downward flow is thus undisturbed. FIG. 4 shows separate upflow and downflow sections connected by a chamber to change the flow direction. This construction also requires no internal conduits for catalyst and oil.

Reactor Transistion Section

The reactor transition section functions to reverse the flow direction from upflow to downflow. While many configurations, ranging from a simple piping connection to a specially cast section can be used, it is very beneficial if a smooth transition can be made from upflow to downflow. Thus I prefer to accomplish this reversal without significant separation of the solid and vapor phases. Phase separation leads to catalyst-lean regions of cracking which are subject to thermal reactions and the loss of desirable product selectivities noted previously.

The preferred strategies for reversing the gas-solids flow are:

(1) a smooth curve in the confinement geometry very near the mixing section, or (2) an impingement surface somewhat downstream of the mixing section.

Sharp curves in the flow conduit will cause gas-solids flow to separate and the solids to be thrown towards the outer radius of the curve. This effect is the result of the greater density, hence greater centrifugal force, acting on the solids as they negotiate a curve, and is the basis for cyclone separators.

Since the preservation of a uniform gas-solids mixture is paramount for the optimum use of the present invention, a simple U-bend in the reactor is a poor way to connect the upflow and downflow sections. A smooth curve in the confinement geometry very near the mixing section, however, will be satisfactory if the curve occurs in the region where the gas-solids flow is not yet fully established. In this region the flow is highly turbulent and significant velocity components exist in all three coordinate directions; typically vortices of many sizes are present and migrate in random directions. If such a flow passes around a curve the random motions of the fluid preserve a dispersion of the two phases, that is, there is still "disorder propagation" within the fluid. By contrast, a fully developed flow has very small velocity components in the radial and angular directions and has less resistance to phase segregation in a curved conduit.

FIGS. 2 and 3 (Invention) illustrate reactor transition sections based on reversing the flow very near the mixing section. In FIG. 2 the flow passes from a central upflow conduit to a downflow initially annular conduit by flowing against a hemitoroidal surface in the hemispherical ceiling of the transition section. The radius of this surface is preferably between 5 and 10 times the radius of the upflow conduit. FIG. 3 shows a design in which gas-solids flow passes from an annular upflow section to a central downflow section via a half-torus defined between the ceiling of the transition section and the mouth of the downflow conduit. In this configuration the cross-sectional area for flow in the transition section should at all points be between 75% and 150% of the cross-sectional area for flow in the entrance to the downflow conduit.

Where it is not possible or desired to locate the transition section in the region of developing flow, an adequate flow reversal may be realized with an impingement plate as shown in FIG. 4 (Invention). In this configuration a substantially fully developed gas-solids flow impinges on a flat surface having a width equal to 0.75 to 1.5 times the diameter of the approaching upflow conduit, a length of 10 to 30 times the width, and an angle of 5 to 20 degrees disposed from vertical. The solids form a fairly orderly "fog" in a thin, broad volume to one side of the impingement surface, this volume being contained in a large flat chamber of the same width as the impingement surface. The lower end of this chamber is smoothly connected to the mouth of the downflow reactor and receives a uniform mixture of gas and solids disengaging from the impingement surface. This transition section design operates so as to fan out the solids into a sheet in which there are no regions significantly less dense in catalyst than others, thus preserving the preferred reaction environment which still allowing the flow to change direction.

Regardless of the configuration of the reactor transition section, the section is sized such that the total catalyst residence time expended in flow reversal is minimized. Ideally the reversal is instantaneous, but since this is not practically achievable the reversal time is preferably less than 10% of the total catalyst residence time, more preferably less than 5% of the total, and most preferably less than 1% of the total. It is believed that the design of FIG. 3 is most likely to realize nearly instantaneous flow reversal.

Downflow Reactor Section

The downflow reactor section is preferably constructed to provide an inner surface which is as straight and smooth as possible. Diameter expansions, commonly used on FCC risers, are neither necessary nor preferred on a downflow reactor because there is negligible slip to begin with. Ideally the downflow section is a straight vertical tubular conduit of constant diameter.

The function of the downflow section is to complete the cracking reactions while preserving a flow field which prevents phase segregation. As such it is important in considering the reactor transition section to allow for a smooth fluid connection to the downflow conduit which induces minimal boundary layer separation and eddies. Ideally the connection to the downflow section is highly streamlined and mirror-smooth. Furthermore, it is preferable to have no protrusions of any kind in the downflow section including instrument probes, nozzles, or sampling ports. Unless these items are indispensable to unit operation they should be omitted.

In the preferred embodiment with a constant-diameter downflow section, the velocity of the vapor will increase with distance down the reactor because the cracking reactions result in a volumetric expansion of the reaction mass. The expansion sections used on riser reactors are intended to maintain an approximately constant vapor velocity in the riser despite this expansion, which in turn is preferred to control catalyst/oil slip. The increase in velocity in a downflow reactor is not detrimental and it is unnecessary to modify any equipment to contain this velocity. Depending on the gas-solids separation means chosen, the high exit velocity may be put to good use.

For purposes of calculating residence time of either catalyst or vapor in the reactor, only the vaporizer/reactor time is stated. This ignores the residence time of catalyst and vapor in the separation means, discussed below. While the vapor residence time in a cyclone separator can be substantial —on the order of 1 second—such residence time is not considered part of the residence time in the reactor. The catalyst has lost most of its activity by the time it reaches any separator(s) and the reactants have cooled somewhat due to the endothermic cracking reaction, hence time in the separator(s) is not as critical as time in the reactor. Ideally, no time at all would be required to separate cracked products from spent catalyst but this is not possible, hence some form of separation means, discussed below, is necessary.

For specificity, the post-reactor and post-separation time is ignored, and the guidelines given herein refer exclusively to catalyst/hydrocarbon contact upstream of the separation means.

Reactor Outlet/Catalyst Separation

The outlet of the downflow section preferably connects smoothly to a gas-solids separation means. As the exit flow is oriented downward, a bend may be desired to redirect the flow to a separator oriented differently. Any bend employed should be smooth but of minimum residence time. A 90° elbow having a centerline radius from 3 to 5 times the diameter of the downflow section, for example, would be satisfactory. Under no circumstances should an outlet section be used consisting of one or more radially directed outlets and a cap over the bottom of the downflow section. Such a design will induce a region of locally high catalyst density near the end of the downflow section which may lead to overcracking of the feed.

The gas-solids separation means may take various forms. One or more stages of cyclones or other centrifugal separators are satisfactory. It is also possible to implement an inertial device in which a separation is achieved based on the greater ability of the vapor to negotiate a change of flow direction than the solids, that is, by applying the same phase segregation tendency which was purposefully avoided in the design of the reactor transition section. Either cyclonic or inertial separators achieve greater solids removal at higher inlet velocity, hence are well-suited to treat the exit flow of the downflow section.

A rapid separation of cracked products from spent catalyst is preferred, but not essential, in the process of the present invention. Whether rapid or not, the residence time in the separation step is distinct from the residence time in the combined reactor, as noted previously. The reaction zone is considered to terminate at the point where the gas-solids flow is subjected to any forces or flow features which act to segregate the vapor and solid phases.

Catalyst Stripping

Conventional stripping techniques may be used to remove strippable hydrocarbons from the spent catalyst. Usually these involve contacting the spent catalyst with 1 to 5 wt % steam in a bubbling fluidized bed.

Catalyst Regeneration

The process and apparatus of the present invention can use conventional FCC regenerators. Most use a single large vessel with a dense phase, bubbling fluidized bed of catalyst subjected to air or an oxygen-containing gas. High efficiency regenerators may also be used having a fast fluid bed coke combustor, a dilute phase transport riser above it, and a second fluidized bed to collect regenerated catalyst.

Swirl regenerators are disclosed in U.S. Pat. Nos. 4,490,241 and 4,994,424, incorporated by reference.

A crossflow regenerator is disclosed in U.S. Pat. No. 4,980,048, incorporated by reference.

A regenerator with a stacked or Orthoflow type FCC unit is disclosed in U.S. Pat. Nos. 5,032,252 and 5,043,055, incorporated by reference.

I claim:

1. A process for the fluidized catalytic cracking of a hydrocarbon feed oil containing liquid hydrocarbons boiling above 650° F. to catalytically cracked products comprising:

a) upflow vaporization of liquid feed by contacting liquid feed with a source of regenerated zeolite containing catalyst, in a base portion of a vertical vaporizer comprising a vertical tube at feed vaporization conditions including a hydrocarbon residence time of 0.05 to 5.0 seconds, and wherein said vaporization conditions are sufficient to vaporize the feed and convert less than 50%, by weight, of the feed to products boiling below 650° F., to produce a vaporized mixture of feed which is completely vaporized and catalyst which is discharged up from said vertical vaporizer;

b) reversing the direction of flow of said feed and catalyst; and c) downflow cracking of said vaporized mixture in a vertical tube downflow reactor having a height of 5 to 150 feet, a top portion receiving said feed and catalyst and a bottom portion discharging cracked products and spent catalyst, said reactor operating at downflow cracking conditions including a hydrocarbon residence time of 0.05 to 5.0 seconds, and sufficient to convert additional amounts of feed to cracked products boiling below 650° F. to produce a downflow cracking reactor product mixture of spent cracking catalyst and cracked hydrocarbons which are discharged from the bottom of said tube downflow reactor and wherein at least 50 wt % of said vaporized hydrocarbons are cracked products boiling below 650° F. and wherein said vaporizer has a volume and said tube downflow reactor has a volume and the ratio of vaporizer:(vaporizer+downflow reactor) volume is from 5:95 to 50:50;

d) separating said tube downflow reactor product mixture in a solids/vapor separation means to produce a vapor phase of cracked products which is recovered as a product and a solids rich stream of spent cracking catalyst containing coke and strippable hydrocarbons;

e) stripping said spent catalyst in a stripping means operating at catalyst stripping conditions to produce stripped catalyst containing coke;

f) regenerating said stripped catalyst in a catalyst regeneration means at catalyst regeneration conditions including contact with an oxygen containing gas to produce regenerated catalyst; and g) recycling said regenerated catalyst to said base portion of said vertical vaporizer.

2. The process of claim 1 wherein there is a catalyst:oil weight ratio in said vertical vaporizer of 4:1 to 20:1.

3. The process of claim 1 wherein the catalyst in said vaporizer has a residence time of less than 5 seconds and hydrocarbon feed has a residence time in said vaporizer less than 50% of said catalyst residence time.

4. The process of claim 2 wherein hydrocarbon residence time is less than 25% of catalyst residence time.

5. The process of claim 1 wherein said vaporizer has a volume and said downflow reactor has a volume and the ratio of vaporizer:(vaporizer+downflow reactor) volume is from 5:95 to 85:15.

6. The process of claim 5 wherein the ratio vaporizer-

:(vaporizer+downflow reactor) volume is from 5:95 to 30:70.

7. The process of claim 1 wherein the vertical vaporizer has a diameter of at least 1 foot and a height of 5 to 150 feet.

8. The process of claim 1 wherein a smooth transition is made from upflow to downflow which achieves flow reversal without significant separation of catalyst and vapor.

9. The process of claim 8 wherein the transition from upflow to downflow occurs by discharging vapor from the upflow vaporizer into the center of a half-torus and connecting the perimeter of the half-torus to the inlet perimeter of the downflow reactor.

10. A process for the fluidized catalytic cracking (FCC) of a hydrocarbon feed oil containing liquid hydrocarbons boiling above 650° F. to catalytically cracked products comprising:

a) upflow vaporization of liquid feed by contacting liquid feed with a regenerated catalyst containing at least 25 wt % zeolite, based on the zeolite content of makeup catalyst to the FCC process, in a base portion of a vertical vaporizer comprising a vertical tube at feed vaporization conditions including a hydrocarbon residence time of 0.05 to 5.0 seconds, and wherein said vaporization conditions include a catalyst residence time at least twice that of hydrocarbon feed and sufficient to vaporize all the feed but convert less than 50% by weight to products boiling below 650° F. and produce a mixture of vapor and catalyst discharged up from said vaporizer;

b) smoothly reversing the direction of flow of said vapor and catalyst without inertially separating catalyst from vapor to produce a downflowing mixture;

c) downflow cracking of said downflowing vaporized mixture in a vertical downflow reactor having a height of 5 to 150 feet, a top portion receiving said downflowing mixture and a bottom portion discharging cracked products and spent catalyst, said reactor operating at downflow cracking conditions including a hydrocarbon residence time of 0.05 to 5.0 seconds, a catalyst residence time no greater than the residence time of said hydrocarbon and sufficient to convert additional amounts of feed to cracked products boiling below 650° F. to produce a product mixture of spent cracking catalyst and cracked hydrocarbons which are discharged from the bottom of said downflow reactor and wherein at least 50 wt % of said vaporized hydrocarbons are cracked products boiling below 650° F.;

d) inertially separating cracked products from spent catalyst discharged from said bottom of said downflow reactor in a solids/vapor separation means to produce a vapor phase of cracked products which is recovered as a product and a solids rich stream of spent cracking catalyst containing coke and strippable hydrocarbons;

e) stripping said spent catalyst in a stripping means operating at catalyst stripping conditions to produce stripped catalyst containing coke;

f) regenerating said stripped catalyst in a catalyst regeneration means at catalyst regeneration conditions including contact with an oxygen containing gas to produce regenerated catalyst; and g) recycling said regenerated catalyst to said base portion of said vertical vaporizer.

11. The process of claim 10 wherein there is a catalyst:oil weight ratio in said vertical vaporizer of 4:1 to 20:1.

12. The process of claim 10 wherein the catalyst in said vaporizer has a residence time of less than 5 seconds and hydrocarbon feed has a residence time in said vaporizer less than 25% of said catalyst residence time.

13. The process of claim 12 wherein hydrocarbon residence time is less than 10% of catalyst residence time.

14. The process of claim 10 wherein said vaporizer has a volume and said downflow reactor has a volume and the ratio of vaporizer:(vaporizer+downflow reactor) volume is from 5:95 to 85:15.

15. The process of claim 14 wherein the ratio vaporizer:(vaporizer+downflow reactor) volume is from 5:95 to 30:70.

16. The process of claim 15 wherein the vertical vaporizer has a diameter of at least 1 foot and a height of 5 to 150 feet.

17. The process of claim 10 wherein said smooth reversing of the direction of flow of said vapor to produce a downflowing mixture occurs by discharging vapor from the upflow vaporizer into the center of a half-torus and connecting the perimeter of the half-torus to the inlet perimeter of the downflow reactor.

* * * * *